United States Patent [19]

McKenzie

[11] 4,049,203

[45] Sept. 20, 1977

[54] COAL SLURRY DRYING APPARATUS

[75] Inventor: Edwin Charles McKenzie, Wallington, England

[73] Assignee: Babcock & Wilcox, Limited, London, Great Britain

[21] Appl. No.: 711,925

[22] Filed: Aug. 5, 1976

[51] Int. Cl.[2] ..... B02C 23/30

[52] U.S. Cl. ..... 241/52; 241/57; 241/103; 241/109

[58] Field of Search ..... 241/18, 23, 52, 53, 241/57, 58, 65, 103, 106, 109

[56] References Cited

U.S. PATENT DOCUMENTS

| | | | |
|---|---|---|---|
| 1,834,094 | 12/1931 | Fraser | 241/109 |
| 2,041,287 | 5/1936 | Frisch | 241/52 |
| 3,044,716 | 7/1962 | Frenkel et al. | 241/103 |

*Primary Examiner*—Granville Y. Custer, Jr.

*Attorney, Agent, or Firm*—J. M. Maguire; R. J. Edwards

[57] ABSTRACT

A coal slurry drier which comprises a pulverizer having a housing enclosing a pulverizing zone including horizontally disposed upper and lower grinding rings. A circular row of rotatable grinding elements is positioned between the upper and lower rings. Heated carrier air is passed through the pulverizing zone. A conduit delivers the coal slurry to the pulverizer for drying and pulverization. The conduit includes an insulated portion extending through the housing and has its outlet located within the pulverizing zone.

2 Claims, 1 Drawing Figure

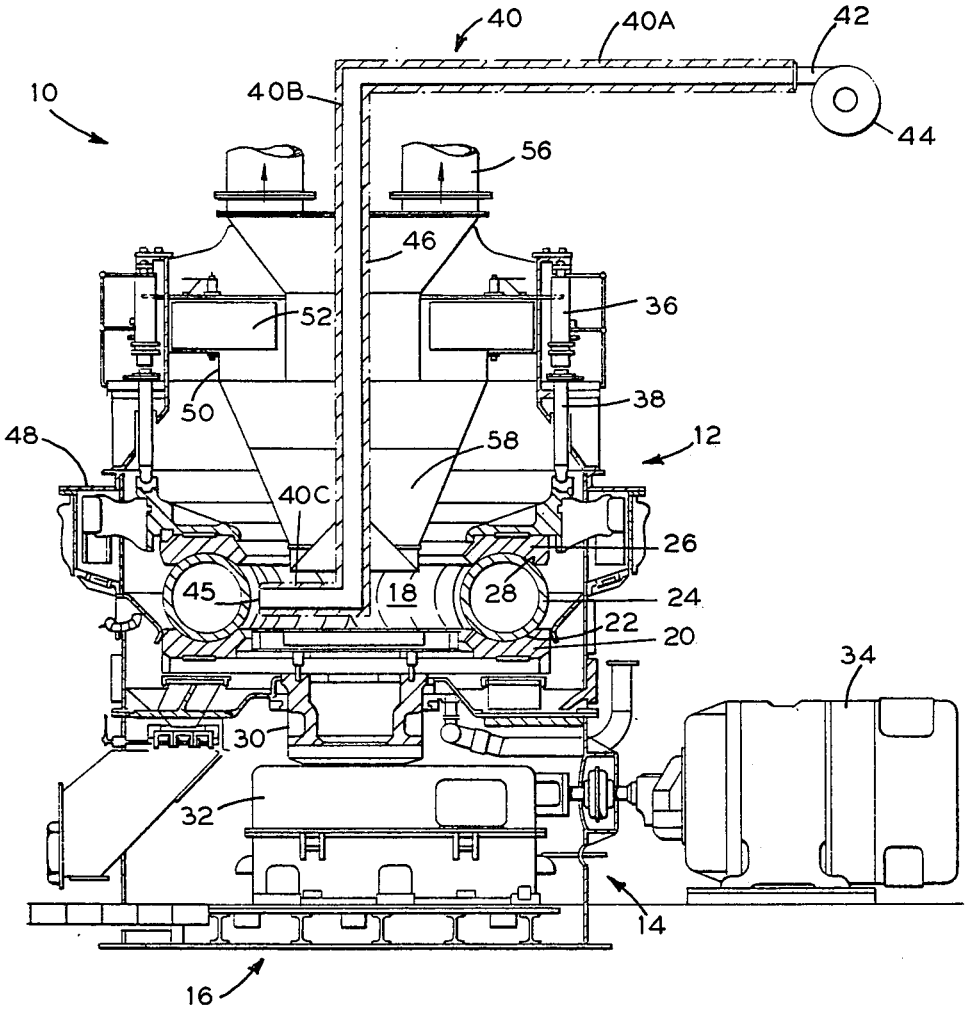
40
40A
42
10
40B
44
56
46
52
36
50
38
48
58
12
40C
26
45
18
28
24
22
20
34
30
32
14
16

COAL SLURRY DRYING APPARATUS

BACKGROUND OF THE INVENTION

The invention relates to the utilization of pipeline slurry, and more particularly to the drying of coal slurry preparatory to firing in a vapor generator.

Where a coal fired power plant is located at a distance from a coal mine, the coal can be economically conveyed from the mine to the plant as a slurry in a hydraulic pipeline. The present invention arose from a consideration of means by which the coal that has been delivered in a slurry through the pipeline can be brought to the condition required for burning in the power plant vapor generators. It is an object of the invention to provide the means whereby coal can be conveyed directly from the coal mine to the power plant, dried, and ground to the range of fineness appropriate for combustion, and burned in the power plant vapor generators, without incurring the capital cost and running expense of dewatering equipment.

SUMMARY OF THE INVENTION

In accordance with the invention, there is provided a slurry drier comprising a pulverizer having a housing enclosing a pulverizing zone including horizontally disposed upper and lower grinding rings. A circular row of rotatable grinding elements is positioned between the upper and lower rings and means are provided to pass heated air through the pulverizing zone. A conduit delivers coal slurry to the pulverizer for drying and pulverization. The conduit includes an insulated portion which extends through the housing and an outlet located within the pulverizing zone and positioned to direct the discharging slurry toward the grinding elements.

BRIEF DESCRIPTION OF THE DRAWINGS

The drawing is a sectional elevation of a ball and race pulverizer embodying the invention.

DESCRIPTION OF THE PREFERRED EMBODIMENT

In general, the illustrated pulverizer 10 includes a cylindrical upper housing section 12 and a lower housing section 14 supported on a foundation 16. The upper housing section 12 encloses the pulverizing or grinding zone 18 of pulverizer 10 and includes a lower horizontally disposed grinding ring 20 having a circular groove or race 22 formed in its upper face to support a circualr row of grinding balls 24. The balls in turn support an upper grinding ring 26 whose lower face is provided with a circular groove or race 28 engaging the circular row of balls. The lower grinding ring 20 is connected to the upper end portion of a stub shaft 30 which is rotated by a gear reducer 32 located in the lower housing section 14 and powered by a motor 34 situated outside of the pulverizer. The upper grinding ring 26 does not rotate and is urged downwardly against the row of grinding balls 24 by a plurality of circumferentially equispaced loading cylinders 36 acting through members 38.

In accordance with the preferred embodiment, there is shown an insulated conduit 40 consisting of first, second and third sections 40A, 40B, and 40C, resectively. The first section 40A includes the conduit inlet 42 which is connected to a pump 44 to receive a viscous coal slurry originating from a source, not shown. The second section 40B is vertically oriented and projects downwardly through the top of the upper housing section 12 to a position withhin the circle defined by the row of grinding balls 24. The second section 40B is centrally located and, as shown, is preferably coaxial with the upper housing section 12. The third section 40C is horizontally oriented and includes the conduit outlet 45 which is directed to discharge coal slurry toward the grinding balls 24 and is positioned in spaced adjacent relation therewith. The third section 40C, as shown, has its central axis preferably coplanar with the central axes of the grinding balls 24. The conduit 40 is covered with the insulation 46 to inhibit any tendency by the coal slurry to cause an obstruction by drying within the conduit. While it is recognized that the continued flow of slurry will have a cooling effect on conduit 40, this would not be sufficient to carry away the heat generated by the hot carrier air flowing through the upper housing section 12. Insulation is, therefore, an essential element of the invention and must be provided for conduit 40, and particularly for the third section 40C and that portion of the second section 40B which lies within the upper housing section 12.

The heated carrier air enters the housing section 12 through an encircling duct 48 for inward flow toward the grinding balls 24, entraining the pulverized coal, and thence flowing upwardly through a classifier 50 equipped with a series of circumferentially disposed angularly positioned upright vanes 52 located adjacent the top of housing section 12. The vanes 52 are adjustable for determining the size range of pulverized coal discharging through the burner pipes 56. Oversize coal particles are recirculated back to the pulverizing zone 18 by the return chute 58.

In the operation of the pulverizer 10, coal slurry conveyed through the insulated conduit 40 is discharged toward the grinding balls 24 and passes around them with the coal being pulverized and dried in the process. Each of the grinding balls 24 revolves on a continuously changing axis and will scrape itself clean even if the coal-to-water ratio in the slurry were such as to constitute a thick paste. The heated carrier air passes upwardly around the outside of the balls 24, entraining the ground coal and carrying it upwardly toward the classifier vanes 52 and therethrough the burner pipes 56. The combination of the heat of the carrier air and the heat generated by the operation of the grinding balls dries the slurry so that the pulverized coal being carried upwardly to the pipes 56 is in condition to be fed directly to the burners of a vapor generator, not shown.

While in accordance with the provisions of the statutes there is illustrated and described herein a specific embodiment of the invention, those skilled in the art will understand that changes may be made in the form of the invention covered by the claims, and that certain features of the invention may sometimes be used to advantage without a corresponding use of the other features.

I claim:

1. A slurry drier comprising a pulverizer having a housing enclosing a pulverizing zone including horizontally disposed upper and lower grinding rings, a circular row of rotatable grinding elements positioned between the upper and lower rings, means for passing heated carrier air through the pulverizing zone, a fixed tubular walled conduit for delivering slurry to be dried and pulverized in the pulverizing zone, the conduit having a horizontally oriented outlet section surrounded by the grinding elements and discharging thereto, and a vertically oriented section connected to the outlet section and extending upwardly through the top of the housing, and wherein insulation covers the walls of the horizontally and vertically oriented sections thereby inhibiting the drying of slurry within said conduit.

2. The slurry drier according to claim 1 including the outlet section having its central axis coplanar with the central axes of said grinding elements.

* * * * *

UNITED STATES PATENT AND TRADEMARK OFFICE

CERTIFICATE OF CORRECTION

PATENT NO. : 4,049,203

DATED : 9/20/77

INVENTOR(S) : Edwin C. McKenzie

It is certified that error appears in the above-identified patent and that said Letters Patent are hereby corrected as shown below:

Column 1, line 65 "resectively" should read --respectively--.

Column 2, line 3 "withhin" should read --within--.

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*